United States Patent [19]

Riedger

[11] Patent Number: 5,041,777

[45] Date of Patent: Aug. 20, 1991

[54] VOLTAGE CONTROLLED AND CURRENT LIMITED POWER SUPPLY

[75] Inventor: Thomas Riedger, Eckental, Fed. Rep. of Germany

[73] Assignee: U.S. Philips Corporation, New York, N.Y.

[21] Appl. No.: 587,309

[22] Filed: Sep. 21, 1990

[30] Foreign Application Priority Data

Sep. 30, 1989 [DE] Fed. Rep. of Germany ..... 3932776

[51] Int. Cl.[5] ..... G05F 1/565; G05F 1/573

[52] U.S. Cl. ..... 323/277; 323/908; 363/89

[58] Field of Search ..... 323/273, 275, 276, 277, 323/280, 908; 363/89

[56] References Cited

U.S. PATENT DOCUMENTS

| | | | |
|---|---|---|---|
| 3,327,201 | 6/1967 | Brantley, Jr. | 323/277 |
| 3,679,961 | 7/1972 | Hamilton | 323/908 |
| 3,723,774 | 3/1973 | Rogers | 323/277 |
| 4,019,096 | 4/1977 | Bullinga | 323/277 |
| 4,176,309 | 11/1979 | Schulz et al. | 323/277 |
| 4,254,372 | 3/1981 | Moore, Jr. | 323/277 |
| 4,338,646 | 7/1982 | Davis et al. | 323/276 |
| 4,346,342 | 8/1982 | Carollo | 323/276 |
| 4,704,572 | 11/1987 | Melbert | 323/275 |

*Primary Examiner*—Peter S. Wong

*Attorney, Agent, or Firm*—Bernard Franzblau

[57] ABSTRACT

A current supply arrangement includes a power transistor (T1) driven by a control transistor (T2). The power transistor switching path is connected between a terminal (UE+) of an unregulated input direct voltage (UE) and a terminal (UA+) of a regulated supply voltage (UA). A first control amplifier (OP1), drives the control transistor via a first electrode (base) thereof and compares a voltage derived from the supply voltage (UA) with a first reference voltage (Uref). A second control amplifier (OP2) compares a measuring voltage (UM) derived at a current measuring resistor (R10) with a second reference voltage. The voltage control and current regulation results in a system having a small number of elements and a sufficient dynamic control range.

The output of the second control amplifier (OP2) is connected to a second electrode emitter of the control transistor so that, the control transistor operates in emitter arrangement during active voltage regulation and operates in base arrangement during active current limitation.

15 Claims, 1 Drawing Sheet

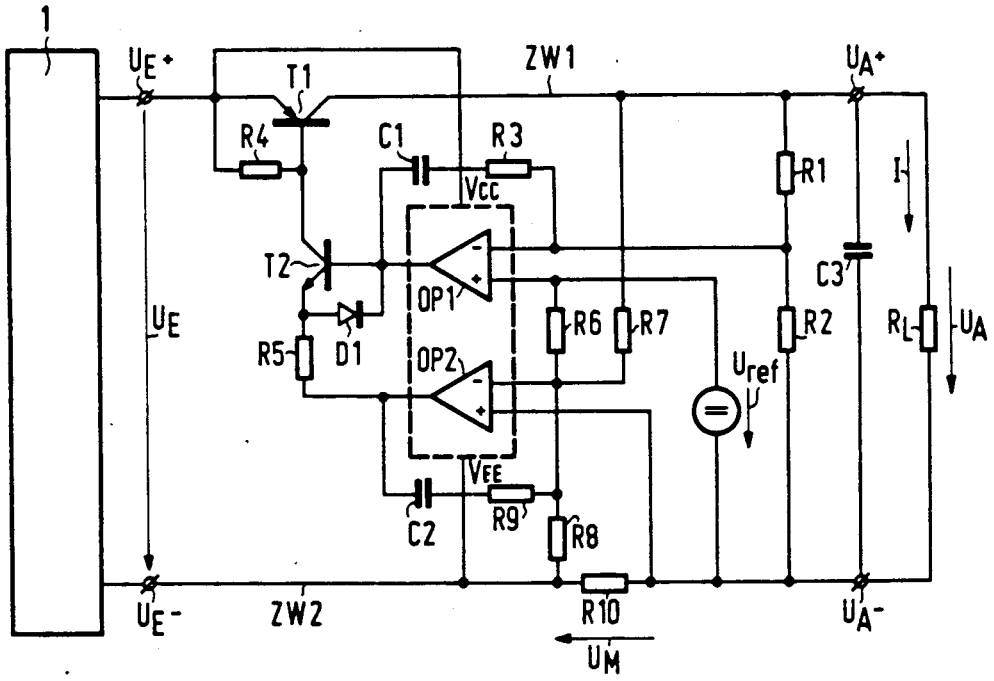
1
UE+
T1
ZW1
UA+
R4
C1
R3
R1
I
Vcc
T2
C3
OP1
UE
R6
R7
R2
RL
UA
R5
D1
OP2
Uref
VEE
C2
R9
R8
UE-
ZW2
R10
UA-
UM

VOLTAGE CONTROLLED AND CURRENT LIMITED POWER SUPPLY

BACKGROUND OF THE INVENTION

This invention relates to a current supply arrangement comprising a power transistor, which is driven by a control transistor and whose switching path is located each time between a terminal of an uncontrolled input direct voltage and a terminal of a controlled supply voltage, a current measuring resistor, a first control amplifier which drives the control transistor through a first electrode and compares a voltage to be derived from the supply voltage with a first reference voltage, and a second control amplifier which compares a measuring voltage to be derived at the current measuring resistor with a second reference voltage.

The operation of electronic circuits requires direct voltages at which a desired voltage value is maintained within a given tolerance range even with mains voltage fluctuations, load current fluctuations and temperature fluctuations. For these reasons, a direct voltage obtained, for example, by rectification from the mains voltage is not directly suitable. The operating voltage for electronic circuits, but it must be stabilized and smoothed by a following voltage control and current limitation means.

A current supply arrangement of the kind mentioned in the opening paragraph is known from U.S. patent Ser. No. 4,346,342. In this apparatus the voltage control means comprise a first control amplifier, which compares a voltage applied to the inverting input and obtained at the tapping point of a voltage divider on the output side with a reference voltage applied to the non-inverting input. The output of the first control amplifier is connected to the base of the control transistor. The current limitation means are constituted by a second control amplifier, which compares a measuring voltage to be derived at the current measuring resistor with a second reference voltage. The output of the second control amplifier is connected through a diode also to the base of the control transistor, while the emitter of the control transistor is connected through a resistor to a reference potential. Thus, the base of the control transistor is driven both by the first control amplifier for voltage control and by the second control amplifier for current limitation. Moreover, the reference voltages of the two control amplifiers are obtained from two separated reference voltages.

SUMMARY OF THE INVENTION

The invention has for its object to provide a current supply arrangement of the kind mentioned in the opening paragraph, and which requires only a small number of elements and has a sufficient dynamic control range.

In a current supply arrangement of the kind mentioned in the opening paragraph, this object is achieved in that the output of the second control amplifier is connected to a second electrode of the control transistor, the control transistor operating in emitter arrangement during active voltage control and operating in base arrangement during active current limitation.

The first electrode is more particularly the base and the second electrode the emitter of the control transistor, and the control transistor operates in emitter arrangement during active voltage control and operates in base arrangement during active current limitation. During normal operation, the first control amplifier is then active for voltage control. When the measuring voltage at the current measuring resistor exceeds the limit value determined by the second reference voltage and its output voltage increases, the control transistor is operated in base arrangement and the load current of the control transistor decreases to the extent to which the measuring voltage increases. Thus, in a simple manner, by combination of the two control amplifiers by means of the control transistor either the voltage control or the current limitation becomes active and with the use of a small number of elements a sufficient dynamic control range of the current supply arrangement is attained.

In an advantageous embodiment, a resistor is arranged between the output of the second control amplifier and the emitter of the control transistor. A current feedback is obtained by means of the, resistor so that more particularly, the temperature and current dependence of the amplification of the control transistor and the dependence due to tolerance variations in the components are reduced.

In one embodiment, the inverting input of the second control amplifier is connected through a resistor to the terminal of the controlled supply voltage. As a result, a fold-back characteristic curve of the controlled supply voltage in dependence upon the output current is obtained.

In a further embodiment, the first and second reference voltages are obtained from a single reference voltage source. The latter has, for example, the form of a Zener diode or a band gap reference element. For example, the first reference voltage is obtained directly from the reference voltage source, while the second reference voltage may be obtained, for example, by means of a voltage divider from the reference voltage source. When the two reference voltages are obtained from a single reference voltage source, this results in a further saving of elements.

In a further embodiment, a rectifier diode is arranged in parallel opposition to the base-emitter path of the control transistor. This diode limits the voltage at the base-emitter path and thus prevents a possible breakdown, which might otherwise occur upon the passage from voltage control to current limitation, i.e. upon the passage of the operating condition of the control transistor from emitter arrangement to base arrangement.

In one embodiment, the first control amplifier is fed back negatively through the series-combination of a resistor and a capacitor. As a result, a frequency response correction of the first control amplifier is made possible.

In a further embodiment, the second control amplifier is fed back negatively through the series-combination of a resistor and a capacitor. As a result, a frequency response correction of the second control amplifier is possible independently of that of the first control amplifier.

BRIEF DESCRIPTION OF THE DRAWING

The invention will now be described more fully with reference to the accompanying drawing, in which:

The sole FIGURE shows a current supply arrangement comprising voltage control and current limitation means.

DESCRIPTION OF THE PREFERRED EMBODIMENTS

In the embodiment shown in the FIGURE, the voltage control and current limitation means are arranged between a current supply arrangement 1 supplying an uncontrolled direct voltage UE (input voltage) and a load resistor RL, which is traversed by an output current I and at which a controlled supply voltage UA (output voltage) occurs. A first series branch ZW1 includes a pnp power transistor T1, whose base-emitter path is connected through a resistor R4. The power transistor T1 is driven by a control transistor T2. For this purpose, the collector of the control transistor T2 is connected to the base of the power transistor T1. A capacitor C3 and the series-combination of a first resistor R1 and of a second resistor R2 are arranged parallel to the load resistor RL. The centre tapping of the resistors R1, R2 is connected to the inverting input of a first control amplifier OP1. A reference source Uref is arranged between the non-inverting input of the first control amplifier OP1 and the negative reference potential UA− of the output voltage UA. The terminal of the reference voltage source Uref connected to the non-inverting input of the first control amplifier OP1 is connected through a resistor R6 to the inverting input of a second control amplifier OP2. The inverting input of the second control amplifier OP2 is moreover connected through a resistor R7 to the positive terminal UA+ of the output voltage UA. A second series branch ZW2 includes between the negative terminal UE− of the uncontrolled input voltage UE and the negative terminal UA− of the controlled output voltage UA a current measuring resistor R10, at which a measuring voltage UM occurs. The connection of the current measuring resistor R10 connected to the negative terminal UA− of the output voltage UA is connected to the non-inverting input of the second control amplifier OP2 and the connection connected to the negative terminal UE− of the uncontrolled direct voltage UE is connected through a resistor R8 to the inverting input of the second control amplifier OP2. The series-combination of a resistor R3 and of a capacitor C1 is arranged between the inverting input of the first control amplifier OP1 and the output of the first control amplifier OP1 connected in turn to the base of the control transistor T2. The series-combination of a resistor R9 and of a capacitor C2 is arranged between the inverting input of the second control amplifier OP2 and the output of the second control amplifier OP2. The output of the second control amplifier OP2 is connected through a resistor R5 to the emitter of the control transistor T2. A rectifier diode D1 is arranged in parallel opposition to the base-emitter path of the control transistor T2.

The two control amplifiers OP1, OP2 have a common voltage supply source having a positive connection VCC and a negative connection VEE. The voltage required to this end is then derived directly at the direct voltage UE. For this purpose, the positive connection VCC is connected to the positive terminal UE+ and the negative connection VEE is connected to the negative terminal UE− of the uncontrolled direct voltage UE. In applications in which the uncontrolled input direct voltage exceeds the maximum permissible supply voltage of the control amplifiers OP1, OP2, their supply voltage may also be obtained through a simple stabilization circuit.

During normal operation, the first control amplifier OP1 is active for voltage control. In this operating condition, no limitation of the output current I takes place through the second control amplifier OP2. The output of the second control amplifier OP2 is at the potential VEE. Thus, the connection of the resistor R5 connected to the emitter of the control transistor T2 is also at the potential VEE and the control transistor T2 operates in emitter arrangement with current feedback.

The collector current of the control transistor T2 and hence also the base current of the power transistor T1 are proportional to the base voltage of the control transistor T2 due to the current feedback of the control transistor T2 through the resistor R5. The output voltage and hence also the collector current of the power transistor T1 are again proportional to the base current of the power transistor T1. The output current I is controlled in dependence upon the instantaneous value of the load resistor RL in such a manner that the supply voltage UA at the load resistor RL remains constant. The output voltage of the first control amplifier OP1 and hence the voltage at the base of the control transistor T2 are adjusted so that the voltage applied to the inverting input of the first control amplifier OP1 and obtained by division through the voltage divider R1, R2 is equal to the reference voltage Uref applied to the non-inverting input. The current feedback of the control transistor T2 through the emitter resistor R5 has the advantage that the amplification of the control transistor T2 remains stable to a great extent and is determined substantially by the resistance value of the emitter resistor R5 and is less dependent upon the non-linear transmission characteristic curve of the control transistor T2. Thus, the temperature and current dependence of the amplification of the control transistor T2 as well as the dependence on variations per specimen are also reduced.

When the voltage drop UM at the current measuring resistor R10 exceeds the limit value determined by the resistors R6, R7, R8 and by the reference voltage Uref, the output voltage of the second control amplifier OP2 increases. In this operating condition, the second control amplifier OP2 is active for current limitation. As a result, the collector current of the control transistor T2 decreases and hence the base current of the power transistor T1 also decreases. The first control amplifier OP1 operating as a voltage regulator now attempts to maintain by a further increase of its output voltage the base current of the power transistor T1 until the latter finally reaches the positive modulation limit VCC. The base of the control transistor T2 is now at the fixed potential VCC and the control transistor T2 consequently operates in base arrangement. The collector current of the control transistor T2 and hence the output current I decrease to the extent to which the output voltage of the second control amplifier OP2 increases. In the embodiment shown in the FIGURE, a fold-back characteristic curve of the supply voltage UA in dependence upon the output current I is attained by the resistor R7 connected between the positive terminal UA+ of the output voltage UA and the inverting input of the second control amplifier OP2. The combination of the two output signals of the first control amplifier OP1 operating as a voltage regulator and of the second control amplifier OP2 operating as a current limiter takes place solely by one element, i.e. by the control transistor T2, which, depending upon whether the voltage regulation or the current limitation is active, operates either in emitter arrangement or in base arrangement. As a result of current feedback via the resistor R5, the amplification of the control transistor T2 remains constant to a great extent in both operating conditions. In an advantageous embodiment, use is made for the first and the second control amplifier OP1, OP2 of a double operational amplifier integrated in one element, whose common mode input voltage range includes the value of the potential VEE. With the use of a double operational amplifier, not only a reduction of the number of elements, but also a saving in space and cost is obtained.

Upon the passage from voltage regulation to current limitation, i.e. upon the passage of the operating condition of the control transistor T2 from emitter arrangement to base arrangement, the polarity of the voltage of the base-emitter path of the control transistor T2 can be reversed. The diode D1 arranged in parallel opposition to the base-emitter path in this case limits the voltage and thus prevents a breakdown of the base-emitter path. The series-combination of the capacitor C1 and the resistor R3 and of the capacitor C2 and the resistor R9 constitute negative feedback networks of the control amplifiers OP1 and OP2, which serve for frequency response correction. They can be dimensioned independently of the respective control amplifier OP1, OP2. The reference voltage Uref is produced, for example, by means of a Zener diode or of a band gap reference element. From the single reference voltage Uref the nominal values of both the first and the second control amplifiers are obtained. The current supply arrangement with voltage regulation and current limitation means operates in a reliable manner even with very small differences between the input voltage UE and the supply voltage UA (low-drop-out voltage). As a result, a higher efficiency and a higher supply voltage are obtained using a relatively small input voltage.

In a further embodiment not shown in the FIGURE, a current supply arrangement can be realized in which, as compared with the embodiment shown in the FIGURE, all voltages and currents have reversed polarities. In that case, all transistors are replaced by their complementary types, while for the diode D1 the anode and the cathode are interchanged. For the second control amplifier OP2 a type is used whose common-mode input voltage range includes the values of the potential VCC.

I claim:

1. A current supply arrangement comprising: a power transistor driven by a control transistor wherein a switching path of the power transistor is coupled between a terminal of an uncontrolled input direct voltage and a terminal of a controlled supply voltage, a current measuring resistor, a first control amplifier, which drives the control transistor through a first electrode and compares a voltage derived from the controlled supply voltage with a first reference voltage, and a second control amplifier which compares a measuring voltage derived at the current measuring resistor with a second reference voltage, and means connecting an output of the second control amplifier is to a second electrode of the control transistor whereby the control transistor operates in emitter arrangement during active voltage regulation and operates in base arrangement during active current limitation.

2. A current supply arrangement as claimed in claim 1, wherein said connecting means comprise a resistor connected between the output of the second control amplifier and an emitter of the control transistor.

3. A current supply arrangement as claimed in claim 2 wherein an inverting input of the second control amplifier is connected via a resistor to said terminal of the controlled supply voltage.

4. A current supply arrangement as claimed in claim 3 wherein the first and the second reference voltage are obtained from a single reference voltage source.

5. A current supply arrangement as claimed in claim 3 further comprising a rectifier diode connected in parallel opposition to a base-emitter path of the control transistor.

6. A current supply arrangement as claimed in claim 5 wherein the first control amplifier is fed back negatively via the series-combination of a resistor and a capacitor.

7. A current supply arrangement as claimed in claim 5, wherein the second control amplifier is fed back negatively via series-combination of a resistor and a capacitor.

8. A current supply arrangement as claimed in claim 1 wherein an inverting input of the second control amplifier is connected via a resistor to said terminal of the controlled supply voltage.

9. A current supply arrangement as claimed in claim 1 wherein the first and the second reference voltage are obtained from a single reference voltage source.

10. A current supply arrangement as claimed in claim 8 further comprising a rectifier diode connected in parallel opposition to a base-emitter path of the control transistor.

11. A current supply arrangement as claimed in claim 1 further comprising a rectifier diode connected in parallel opposition to a base-emitter path of the control transistor.

12. A current supply arrangement as claimed in claim 1 wherein the first control amplifier is fed back negatively via a series-combination of a resistor and a capacitor.

13. A current supply arrangement as claimed in claim 12, wherein the second control amplifier is fed back negatively via a series-combination of a resistor and a capacitor.

14. A current supply arrangement as claimed in claim 1, wherein the second control amplifier is fed back negatively via a series-combination of a resistor and a capacitor.

15. A current supply arrangement as claimed in claim 2 wherein at least one of said control amplifiers is fed back negatively via a series combination of a resistor and a capacitor.

* * * * *

UNITED STATES PATENT AND TRADEMARK OFFICE

CERTIFICATE OF CORRECTION

PATENT NO. : 5,041,777

DATED : August 20, 1991

INVENTOR(S) : THOMAS RIEDGER

It is certified that error appears in the above-identified patent and that said Letters Patent is hereby corrected as shown below:

Title Page:

IN THE ABSTRACT line 6, delete "," (comma);
line 16, change "emitter" to --(emitter)--;
line 17, delete "," (comma).

Column 1, line 24, change ". The" to --as the--;
Column 2, line 17, after "that" insert --,-- (comma).

Claim 1, line 6, delete "," (comma) (second occurrence);
line 9, delete "and";
line 13, delete "is".

Claim 6, line 3, change "the" to --a--.

Claim 7, line 3, after "via" insert --a--.

Signed and Sealed this

Seventeenth Day of November, 1992

*Attest:*

DOUGLAS B. COMER

*Attesting Officer*

*Acting Commissioner of Patents and Trademarks*